US011156232B2

(12) United States Patent
Singleton et al.

(10) Patent No.: US 11,156,232 B2
(45) Date of Patent: Oct. 26, 2021

(54) FAN CONFIGURED TO PRODUCE PINK NOISE

(71) Applicant: Helen of Troy Limited, St. Michael (BB)

(72) Inventors: Michael Singleton, Warwick, RI (US); Brett Mikolajczyk, Shrewsbury, MA (US)

(73) Assignee: Helen of Troy Limited, St. Michael (BB)

( * ) Notice: Subject to any disclaimer, the term of this patent is extended or adjusted under 35 U.S.C. 154(b) by 36 days.

(21) Appl. No.: 16/378,705

(22) Filed: Apr. 9, 2019

(65) Prior Publication Data

US 2019/0316602 A1 Oct. 17, 2019

Related U.S. Application Data

(60) Provisional application No. 62/655,848, filed on Apr. 11, 2018.

(51) Int. Cl.

| | |
|---|---|
| ***F04D 29/66*** | (2006.01) |
| ***F04D 19/00*** | (2006.01) |
| ***F04D 29/30*** | (2006.01) |
| *G10K 15/04* | (2006.01) |

(52) U.S. Cl.

CPC ..... *F04D 29/666* (2013.01); *F04D 19/002* (2013.01); *F04D 29/30* (2013.01); *G10K 15/04* (2013.01)

(58) Field of Classification Search

CPC ..... F04D 29/666; F04D 29/30; F04D 19/002; G10K 15/04

USPC ..... 415/119

See application file for complete search history.

(56) References Cited

U.S. PATENT DOCUMENTS

| | | | | |
|---|---|---|---|---|
| 5,360,469 | A | 11/1994 | Baron | |
| 5,816,910 | A * | 10/1998 | Steele | A61M 21/00 454/370 |
| 7,277,767 | B2 * | 10/2007 | Yuen | H04S 3/002 700/94 |
| 9,089,621 | B1 | 7/2015 | Leyva | |
| 9,456,700 | B2 | 10/2016 | Greener | |
| 9,665,134 | B2 | 5/2017 | Degner et al. | |
| 2014/0086729 | A1 | 3/2014 | Peery et al. | |
| 2017/0246570 | A1 | 8/2017 | Park et al. | |

FOREIGN PATENT DOCUMENTS

| | | |
|---|---|---|
| CN | 107238131 | 10/2017 |
| JP | 2012063673 | 3/2012 |
| WO | 2017/035388 | 3/2017 |

OTHER PUBLICATIONS

International Search Report dated Jul. 16, 2019.

* cited by examiner

*Primary Examiner* — Michael L Sehn

(74) *Attorney, Agent, or Firm* — Rankin, Hill & Clark LLP

(57) ABSTRACT

A fan is provided that includes a fan blade movable relative to a housing. The housing and the fan blade are configured such that the fan generates a pink noise sound profile both when air is exiting the fan housing through an air outlet vent and when air is not exiting the housing through the outlet air vent.

7 Claims, 8 Drawing Sheets

FAN CONFIGURED TO PRODUCE PINK NOISE

BACKGROUND

"White" noise is noise having equal intensity at different frequencies (Hz). WO 2017/035388 A2 discloses an acoustic white noise machine and how the frequency or the noise output is changed by opening and closing an adjustable enclosure.

"Pink" noise differs from white noise in that pink noise is noise having about equal energy per octave (Hz), containing more low-frequency components than white noise. FIG. 1 depicts a graph of pink noise with intensity (dB) on the Y-axis and frequency (Hz) on the X-axis. Pink noise may be found desirable by persons while sleeping.

SUMMARY

In view of the foregoing, a fan is provided that includes a fan blade movable relative to a housing. The housing and the fan blade are configured such that the fan generates a pink noise sound profile both when air is exiting the fan housing through an air outlet vent and when air is not exiting the housing through the outlet air vent.

DETAILED DESCRIPTION

Figure 2:
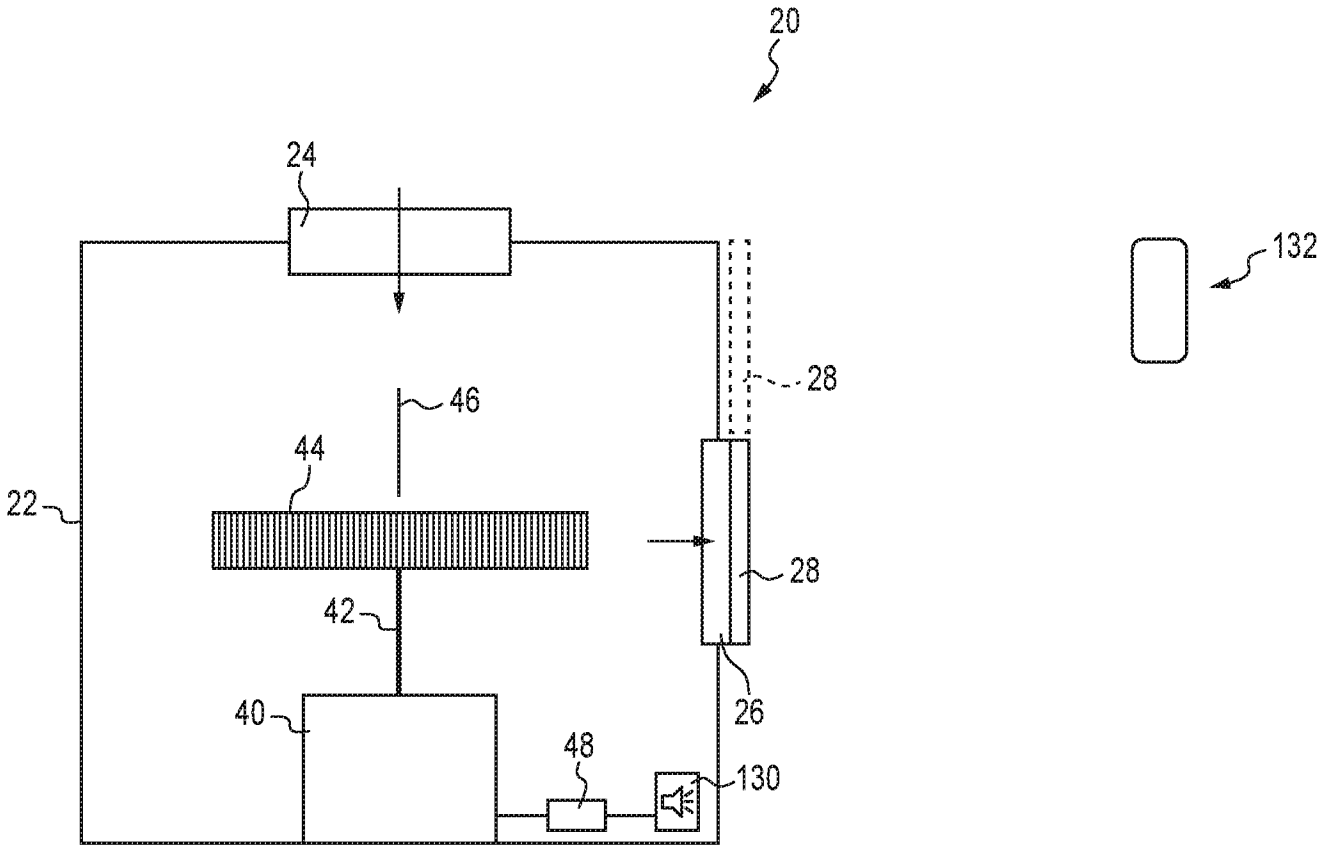
FIG. 2 is a schematic depiction of a fan configured to generate a pink noise sound profile.
Figure 3:
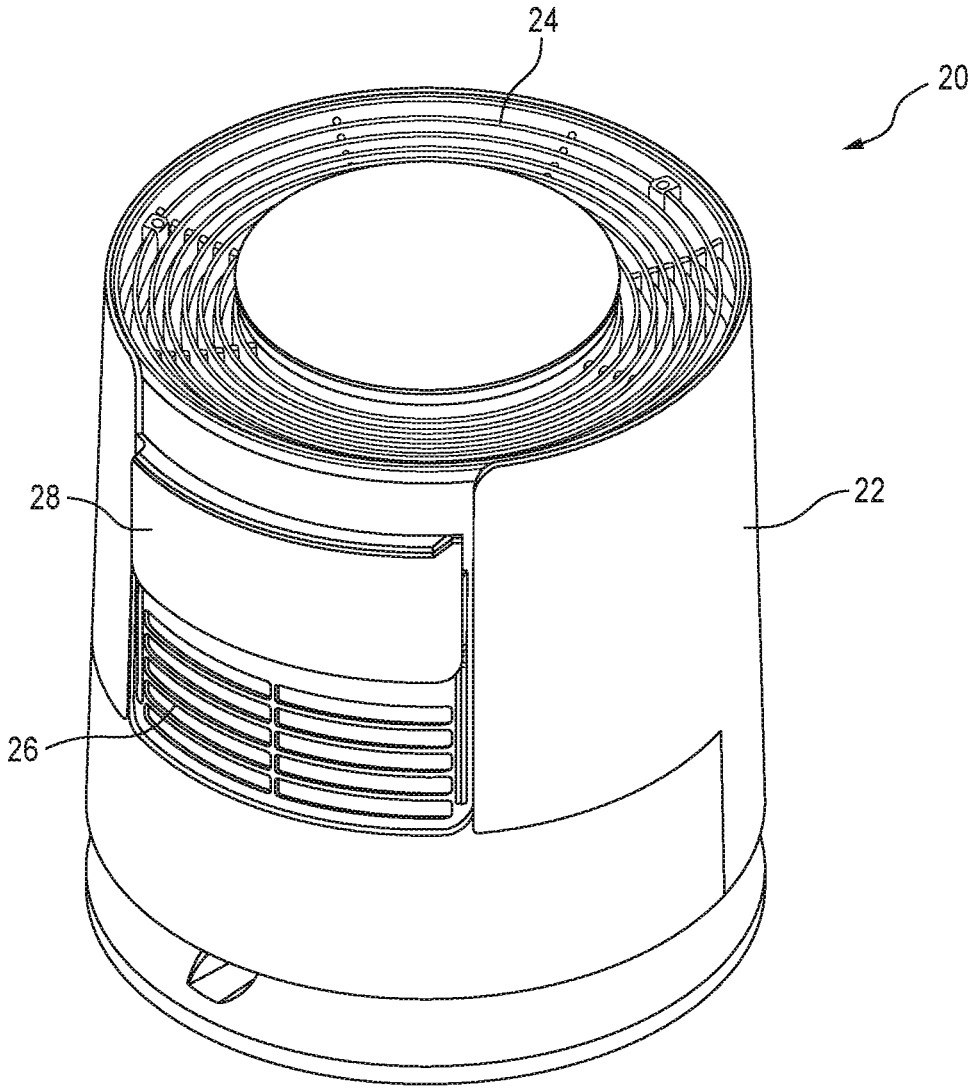
FIG. 3 is a perspective view of a fan according to a particular embodiment with a shutter shown in an open position.
Figure 4:
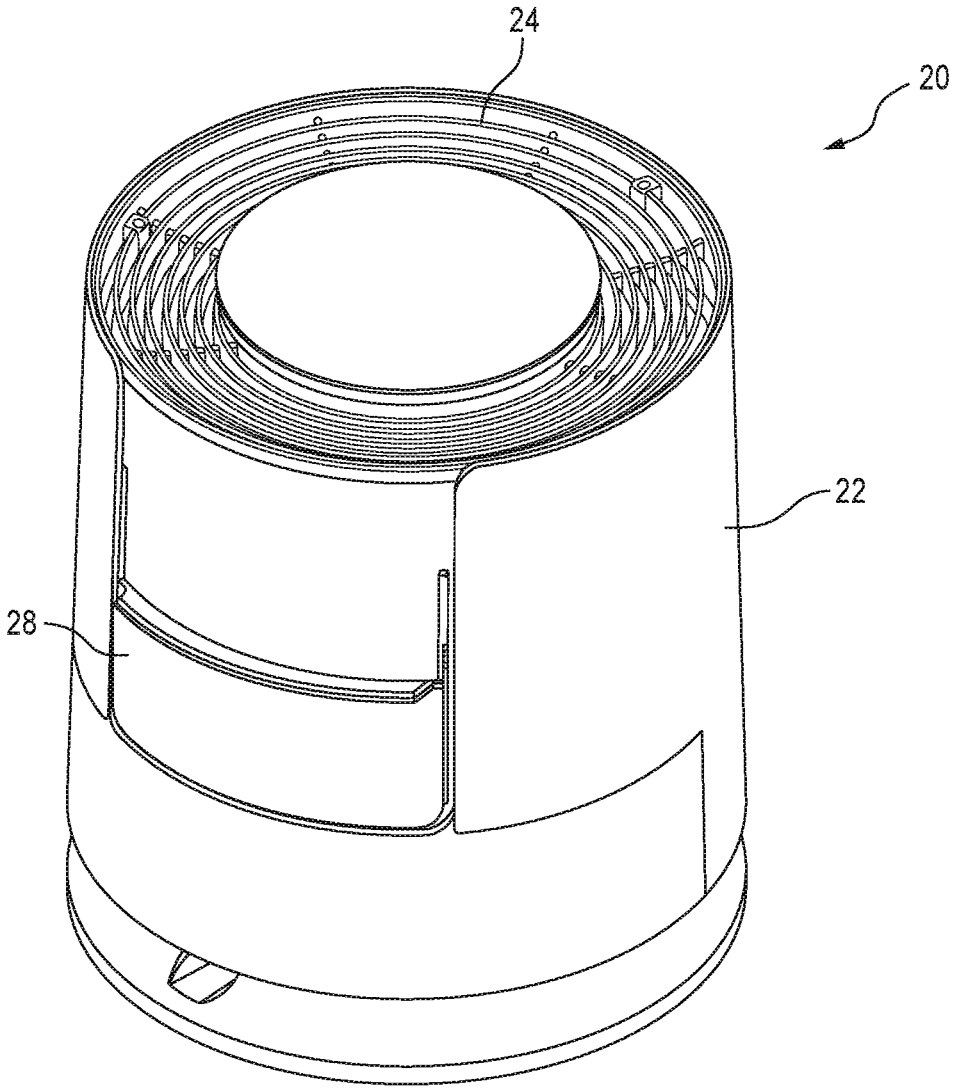
FIG. 4 is a perspective view of the fan in FIG. 3 with the shutter shown in a closed position.

FIG. 2 schematically depicts a fan 20 configured to generate a pink noise sound profile, which will be described in more detail below with reference to FIG. 9. The fan 20 includes a housing 22 having an inlet air vent 24 and an outlet air vent 26. A shutter 28, which can be connected with the housing 22, is movable relative to the housing 22 between an open position (shown in broken lines in FIG. 2) and a closed position (shown in solid lines in FIG. 2). FIGS. 3 and 4 depict a more particular example of the fan 20, however, the fan 20 can take other configurations. FIG. 3 shows the shutter 28 in the open position and FIG. 4 shows the shutter 28 in the closed position. The outlet air vent 26 is open allowing air to exit the housing 22 through the outlet air vent 26 when the shutter 28 is in the open position. The outlet air vent 26 is covered precluding air to exit the housing 22 through the outlet air vent 26 when the shutter 28 is in the closed position.

Figure 5:
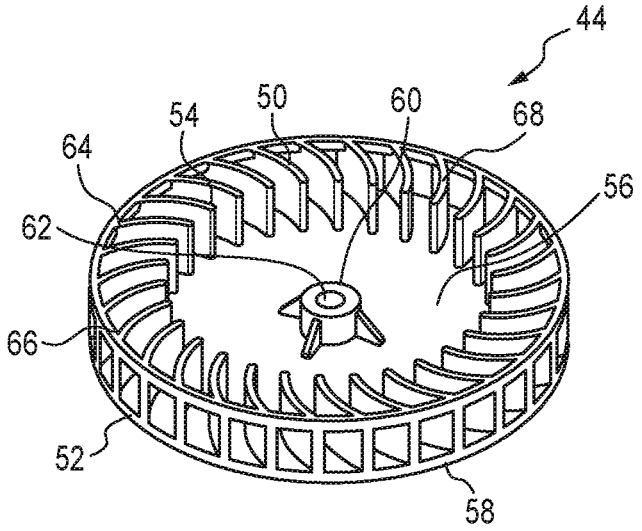
FIG. 5 is a top perspective view of a fan wheel for the fan depicted in FIG. 3.
Figure 6:
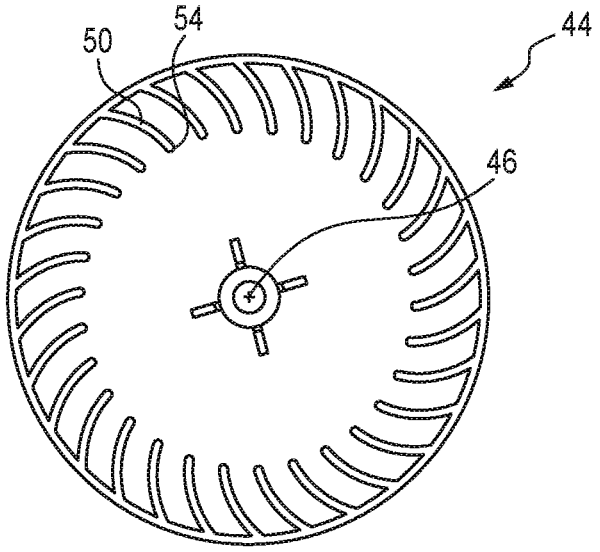
FIG. 6 is a top plan view of the fan wheel depicted in FIG. 4.
Figure 7:
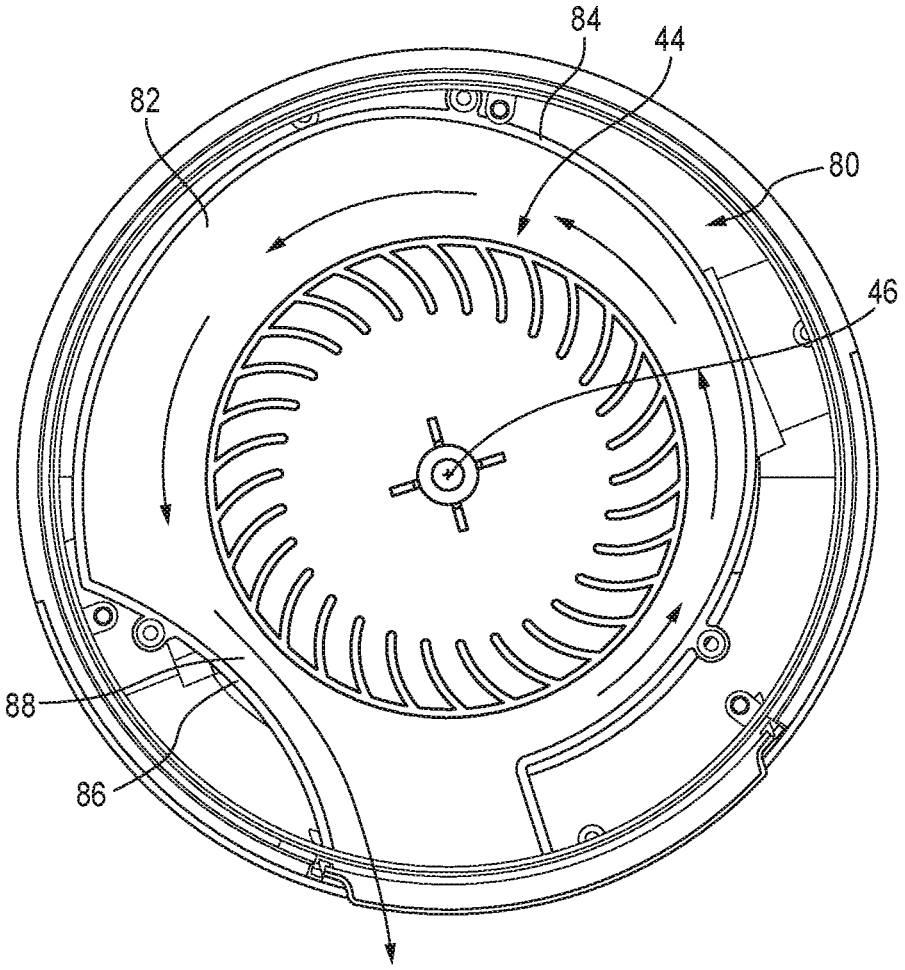
FIG. 7 is a top plan view of the fan wheel depicted in FIG. 4 in a fan shroud of the fan in FIG. 3.

With reference back to FIG. 2, the fan 20 further includes a motor 40 having an output shaft 42 connected with a fan wheel 44. More particular examples of the fan wheel 44 are shown in FIGS. 5-7. With reference back to FIG. 2, the motor 40 connects with the fan wheel 44 through the output shaft 42 such that when power is delivered to the motor 40 via a power source (not shown), the fan wheel 44 rotates about an axis of rotation 46. The power source can be disposable batteries, rechargeable batteries, and capacitive storage, among others. In some embodiments, the power source can also include a power jack for connection of a power cord to a wall outlet, USB outlet, or other charging port. The power source can be in electrical communication with a controller 48 (schematically depicted in FIG. 2) that can control power delivery to the motor 40 and control other components on the fan 20, if desired. When the fan wheel 44 is rotating about the axis of rotation 46, air is drawn into the housing 22 through the inlet air vent 24 and is expelled from the housing 22 through the outlet air vent 26 when the shutter 28 is not covering the outlet air vent 26.

With reference to FIG. 5, the fan wheel 44 includes at least one fan blade 50 and is shown as including a plurality of fan blades 50. Each of the fan blades 50 extends in an axial direction from a fan wheel base 52, which is circular in plan view (see FIG. 6) in the illustrated embodiment. Each fan blade 50 includes a radial inner end 54 that is spaced from the axis of rotation 46 of the fan wheel 44. An upper surface 56 of the fan wheel base 52 is planar in the illustrated embodiment. A lower surface 58 of the fan wheel base 52 can also be planar. A circular void is provided between each of the radial inner ends 54 of the respective fan blades 50 and a hub 60 that is concentric with the axis of rotation 46 and defines an opening 62 for attaching the fan wheel 44 to the output shaft 42 (FIG. 2). Each fan blade 50 also includes a radial outer end 64 that terminates along a peripheral edge of the fan wheel base 52. The fan wheel 44 also includes a circumferential upper support 66 located along an upper axial edge 68 of each fan blade 50 at or adjacent the radial outer end 64 of each fan blade 50.

Each fan blade 50 is a centrifugal fan blade and is forward-curved in the illustrated embodiment, as can be more clearly seen in FIG. 7, which shows air flow in arrows while the fan wheel 44 is rotating expelling air through the outlet air vent 26. For the fan wheel 44 depicted in FIGS. 5-7, the fan wheel 44 has a diameter of 100 mm. Each fan blade 50 measures 15 mm in an axial direction between the upper surface 56 of the fan wheel base 52 and the upper axial edge 68. Thirty fan blades 50 are provided on the fan wheel 44. Each fan blade 50 has an inner blade angle of 58.42° and an outer blade angle of 11.07°. The above described fan wheel 44 can take other configurations and is not limited to the exact dimensions and configurations described herein.

FIG. 7 depicts a shroud 80 in which the fan wheel 44 can be positioned. The shroud 80 can include a lower wall 82, which is planar normal to the axis of rotation 46 in the illustrated embodiment. The shroud 80 can also include an involute side wall section 84 with respect to the axis of rotation 46 and a curved side wall section 86 downstream from the involute side wall section 84. The curved side wall section 86 curves inwardly toward the axis of rotation 46 to define a constricted air path 88 upstream from the outlet air vent 26.

Figure 1:
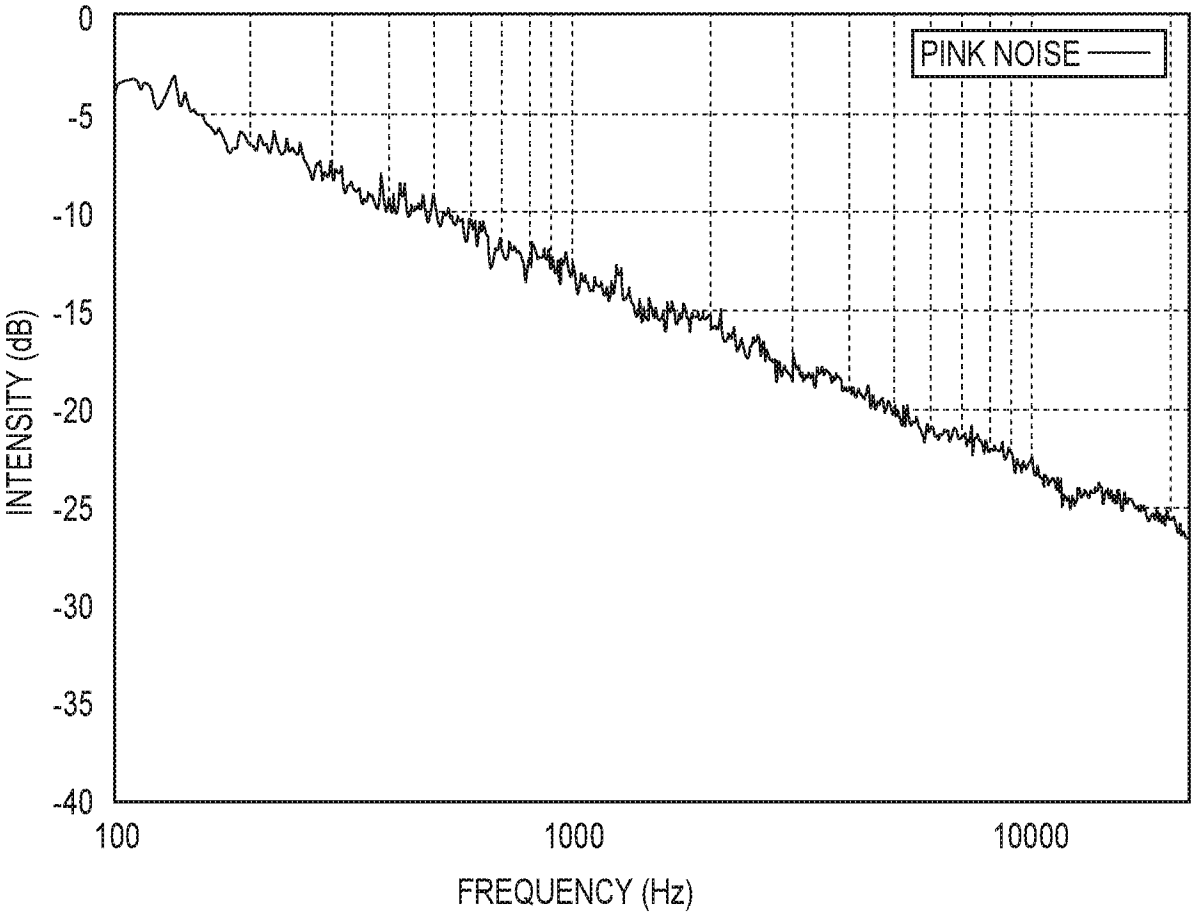
FIG. 1 is a graph of pink noise on a log-log plot with intensity (dB) on the Y-axis and frequency (Hz) on the X-axis.
Figure 8:
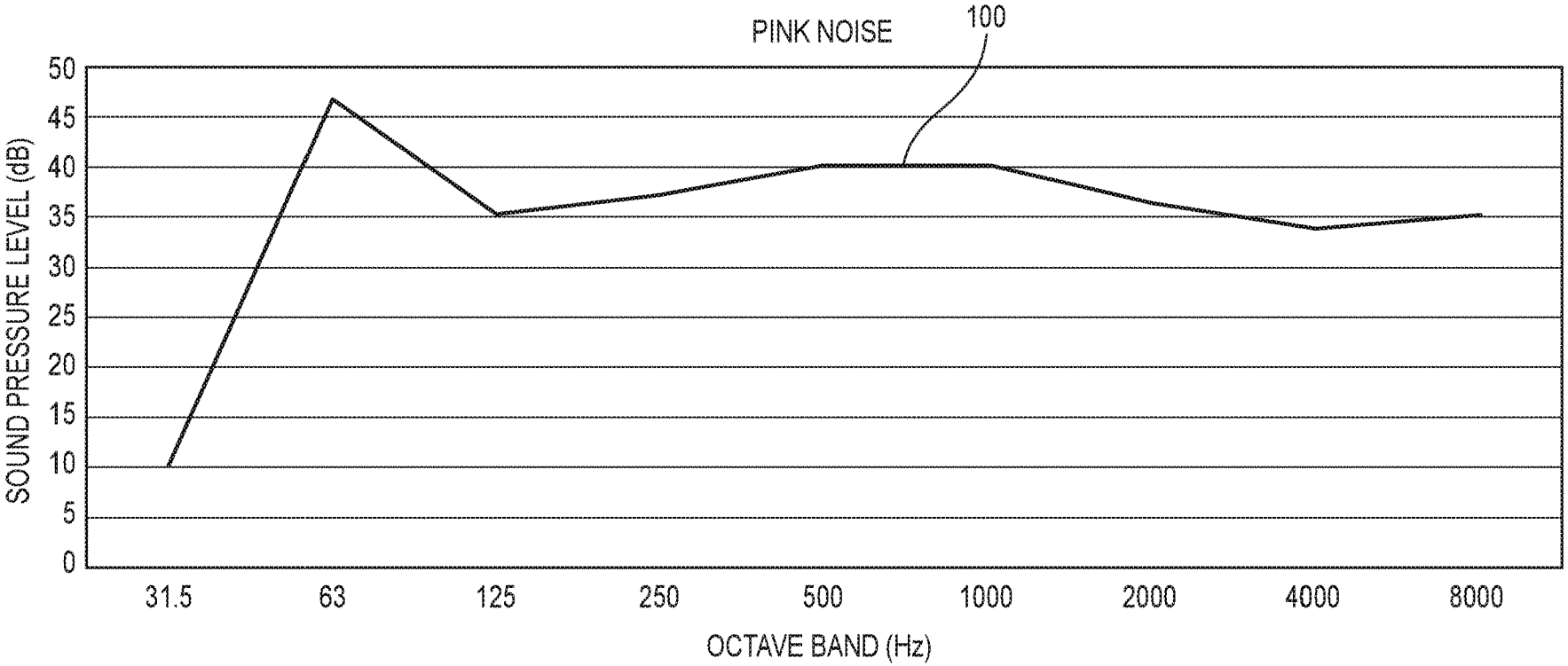
FIG. 8 is a pink noise curve plotted with sound pressure level (dB) on the Y-axis and octave bands (Hz) on the X-axis depicting sound measured by a sound meter where the measured sound was generated by a digital pink noise sound generator.

FIG. 8 depicts a pink noise curve 100 generated using a sound meter measuring sound generated by a digital pink noise generator. The pink noise curve 100 depicted in FIG. 8 differs in shape from the pink noise curve depicted in FIG. 1 because the pink noise curve depicted in FIG. 1 shows a logarithmic scale while the pink noise curve 100 shown in FIG. 8 is not a logarithmic scale. The pink noise curve 100 from FIG. 8 is also shown in FIG. 9.

When the fan wheel 44 is rotating about the axis of rotation 46, the fan 20 generates acoustic pink noise. The housing 22 and the fan blade 50 are configured such that the fan 20 generates a pink noise sound profile, which will be described in more detail below, both when air is exiting the housing 22 through the outlet air vent 26 and when air is not exiting the housing 22 through the outlet air vent 26.

Figure 9:
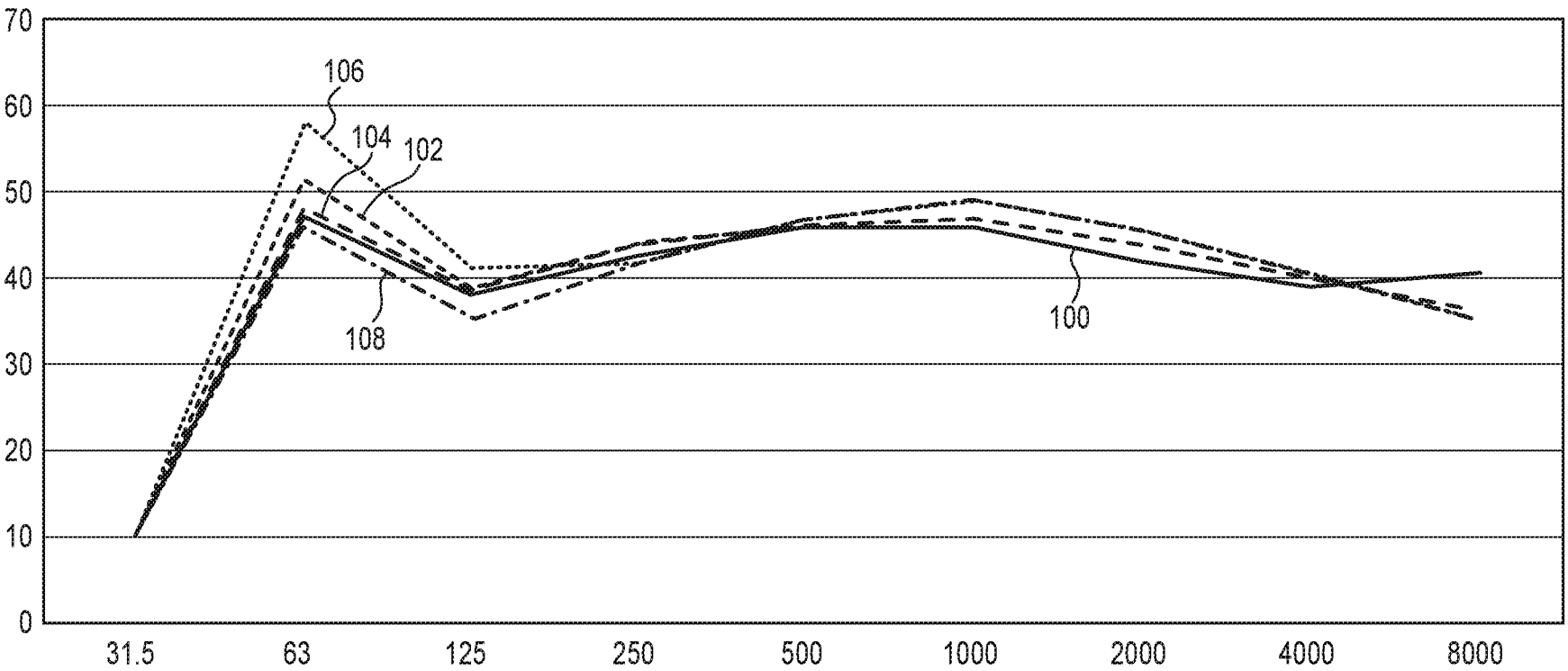
FIG. 9 depicts the pink noise curve from FIG. 8 and pink noise sound profiles generated by a fan configured to generate pink noise, such as the fan depicted in FIGS. 2-4.

FIG. 9 depicts four different curves in addition to the pink noise curve 100. A first generated noise curve 102 plots the sound pressure level (dB) measured at different frequencies (Hz) for the fan 20 with the fan wheel 44 rotating and the shutter 28 in the open position (see FIG. 3). A second generated noise curve 104 also plots the sound pressure level (dB) measured at different frequencies (Hz) for the fan 20 with the fan wheel 44 rotating and the shutter 28 in the open position (see FIG. 3). A third generated noise curve 106 plots the sound pressure level (dB) measured at different frequencies (Hz) for the fan 20 with the fan wheel 44 rotating and the shutter 28 in the closed position (see FIG. 4). A fourth generated noise curve 108 also plots the sound pressure level (dB) measured at different frequencies (Hz) for the fan 20 with the fan wheel 44 rotating and the shutter 28 in the closed position (see FIG. 4). The measurements were made using a sound meter in a reverberation chamber.

As seen in FIG. 9, each generated noise curve 102, 104, 106 and 108 generally follows the pink noise curve 100 in an increasing frequency direction. When considering 31.5 Hz to be a first octave, the third generated noise curve 106 deviates most from the pink noise curve 100 at the second octave (i.e., at 63 Hz). Nevertheless, the deviation at the second octave (63 Hz) of the third generated noise curve 106 from the pink noise curve 100 is within 20% of the measured sound pressure level (dB) at the second octave (63 Hz) for the pink noise curve 100. To the human ear, this 20% deviation is difficult to perceive. Moreover, respective deviations between each generated noise curve 102, 104, 106 and 108 and the pink noise curve 100 from the second octave (63 Hz) in the increasing frequency direction for at least seven additional octaves (e.g., 125 Hz, 250, Hz, 500 Hz, 1000 Hz, 2000 Hz, 4000 Hz, and 8000 Hz) are less than 20%.

In view of the foregoing, the fan 20 is configured to generate a pink noise sound profile, which is a generated noise curve that is within a predetermined offset. This offset can be measured as a numerical sound pressure level (dB) value or as a percentage from the pink noise curve 100 for each frequency of the pink noise curve 100 from a first octave (e.g., 31.5 Hz) in an increasing direction. The predetermined offset can be set such that the pink noise sound profile is within 20% from a respective sound pressure level (dB) measured at each octave (Hz) of the pink noise curve 100 measured along at least 7 additional octaves (e.g., 63 Hz, 125 Hz, 250, Hz, 500 Hz, 1000 Hz, 2000 Hz, 4000 Hz, and 8000 Hz) from the first octave (e.g., 31.5 Hz). Moreover, the predetermined offset can be set such that the pink noise sound profile is within 10% from a respective sound pressure level (dB) measured at a second octave (e.g., 63 Hz) from the first octave (31.5 Hz) of the pink noise curve 100 in an increasing frequency direction to at least seven octaves from the first frequency in the increasing frequency direction. As can be seen from FIG. 9, the predetermined offset is maintained whether the shutter 28 is in the open position or in the closed position.

As mentioned above, the housing 22 and the fan blade 50 are configured such that the fan 20 generates a pink noise sound profile both when air is exiting the housing 22 through the outlet air vent 26 and when air is not exiting the housing 22 through the outlet air vent 26. The fan 20, however, need not only produce an acoustic pink noise sound profile. The fan 20 can also be configured to produce a digital pink noise sound profile.

With reference back to FIG. 2, the fan 20 can also include a speaker 130 in communication a pink noise generation device 132. The speaker 130 is in electrical communication with the controller 48 and can be powered by the power source. The speaker 130 communicates with the pink noise generation device 132 such that pink noise can be emitted from the speaker 130. The pink noise generation device 132 can be external from the fan 20 and can include a portable computing device (e.g., a smart phone) capable of running an application that can generate a digital pink noise signal for playing on the speaker 130. Where the pink noise generation device 132 is external to the fan 20, the speaker 130 can be in wireless communication with the pink noise generation device 132. Also, the pink noise generation device 132 can be provided in or on the housing 22 and/or can be in communication with or provided as part of the controller 48. As such, the speaker 130 can communicate with the pink noise generation device 132 via a wired connection.

When pink noise generation device 132 is communicating with the speaker 130 to play pink noise on the speaker 130, the noise provided by the speaker 130 can follow the pink noise sound profiles described above with reference to FIG. 7. Also, since the pink noise generation device 132 is capable of generating a digital pink noise signal, the pink noise being played on the speaker 130 can even more closely match the pink noise curve depicted in FIG. 8.

Embodiments of a fan have been described above in particularity. The invention, however, is not only limited to the embodiments described above. Instead, the invention is broadly defined by the appended claims and the equivalents thereof.

The invention claimed is:

1. A fan comprising a fan blade movable relative to a housing having an air outlet vent, a shutter movable relative to the housing between an open position and a closed position, a fan wheel in which the fan blade is one of a plurality of fan blades provided on the fan wheel, and a shroud in which the fan wheel is positioned, the shroud includes a lower wall, which is planar normal to an axis of rotation of the fan wheel, an involute side wall section with respect to the axis of rotation and a curved side wall section downstream from the involute side wall section, wherein the outlet air vent is open and allows air to exit the housing through the outlet air vent when the shutter is in the open position, and the outlet air vent is covered and precludes air from exiting the housing through the outlet air vent when the shutter is in the closed position, and the housing, the fan blade and the shutter being configured such that the fan blade moving relative to the housing generates a pink noise sound profile both when the air vent is open and air is exiting the housing through the outlet air vent and when the air vent is closed and air is not exiting the housing through the outlet air vent, wherein the pink noise sound profile is within 20% of a respective sound pressure level (dB) measured at each octave of a pink noise curve measured along at least seven octaves from a first octave.

2. The fan of claim 1, wherein the fan blade is a centrifugal fan blade.

3. The fan of claim 2, wherein the fan blade is a forward-curved fan blade.

4. The fan of claim 1, wherein each of the fan blades extends in an axial direction from a fan wheel base and includes a radial inner end radially spaced from an axis of rotation of the fan wheel.

5. The fan of claim 4, wherein each of the fan blades is a forward-curved fan blade.

6. The fan of claim 1, wherein the pink noise sound profile is within 10% of a respective sound pressure level (dB) measured at a second octave from the first octave of the pink noise curve in an increasing frequency direction to at least seven octaves from the first frequency in the increasing frequency direction.

7. The fan of claim 1, wherein the curved side wall section curves inwardly toward the axis of rotation to define a constricted air path upstream from the outlet air vent.

* * * * *